US010850152B2

(12) United States Patent
Kelly

(10) Patent No.: US 10,850,152 B2
(45) Date of Patent: Dec. 1, 2020

(54) POWER SQUAT EXERCISE MACHINE

(71) Applicant: Sean Kelly, Miami Beach, FL (US)

(72) Inventor: Sean Kelly, Miami Beach, FL (US)

( * ) Notice: Subject to any disclaimer, the term of this patent is extended or adjusted under 35 U.S.C. 154(b) by 44 days.

(21) Appl. No.: 15/787,540

(22) Filed: Oct. 18, 2017

(65) Prior Publication Data

US 2018/0104526 A1 Apr. 19, 2018

Related U.S. Application Data

(60) Provisional application No. 62/410,202, filed on Oct. 19, 2016.

(51) Int. Cl.

*A63B 21/06* (2006.01)
*A63B 23/04* (2006.01)
*A63B 21/00* (2006.01)

(52) U.S. Cl.

CPC ..... *A63B 21/0615* (2013.01); *A63B 21/4033* (2015.10); *A63B 21/4041* (2015.10); *A63B 21/4047* (2015.10); *A63B 23/0405* (2013.01); *A63B 21/159* (2013.01); *A63B 2023/0411* (2013.01)

(58) Field of Classification Search

CPC ..... A63B 21/0615; A63B 21/4047; A63B 21/4033; A63B 21/159; A63B 21/06; A63B 21/00058; A63B 21/00061; A63B 21/65; A63B 21/00; A63B 21/02; A63B 21/04; A63B 23/0405; A63B 2023/0411; A63B 2023/0429; A63B 224/09; A63B 2208/0223; A63B 23/04–0405; A63B 2224/09

See application file for complete search history.

(56) References Cited

U.S. PATENT DOCUMENTS 4,357,010 A * 11/1982 Telle ..... A63B 21/00072 482/113
4,411,425 A * 10/1983 Milnar ..... A63B 21/4029 248/65
4,872,670 A * 10/1989 Nichols ..... A63B 21/0615 482/135

(Continued)

OTHER PUBLICATIONS

"ELITEFTS Power Squat," Jun. 4, 2016 [retrieved Apr. 18, 2019], elitefts, Retrieved from Internet: <https://www.elitefts.com/eliteftstm-power-squat.html> (Year: 2016).*

(Continued)

*Primary Examiner* — Loan B Jimenez
*Assistant Examiner* — Kathleen Vermillera
(74) *Attorney, Agent, or Firm* — Nasser Ashgriz; UIPatent Inc.

(57) ABSTRACT

The power squat exercise machine is an exercise machine for performing a squat exercise in a safe and controlled manner by providing shoulder pads with a specific angle which allows for the optimal comfort, posture, safety, and transfer of strength to a free weight squat. Support members are provided for more stability to the machine. It provides a dual safety stopping mechanism. The stopping mechanism provides controlled movement by the user and a safe entry and exit from the squat exercise machine. An adjustable safety locking mechanism is also provided which allows the user to control the movement range of the resistance.

10 Claims, 12 Drawing Sheets

(56) References Cited

U.S. PATENT DOCUMENTS

| | | | | |
|---|---|---|---|---|
| 7,029,426 | B1 * | 4/2006 | Fuller, Sr. | A63B 21/0615 482/137 |
| 2005/0187078 | A1 * | 8/2005 | Carter | A63B 21/0615 482/94 |
| 2011/0237987 | A1 * | 9/2011 | Du | A61H 15/00 601/24 |
| 2012/0058866 | A1 * | 3/2012 | Hongo | A63B 21/00072 482/131 |
| 2016/0346586 | A1 * | 12/2016 | Pullins | A63B 21/0615 |

OTHER PUBLICATIONS

"York Power Front Squat Machine," Oct. 11, 2013 [retrieved Apr. 18, 2019], Fitness Giant LLC., Retrieved from Internet: <https://www.fitnessgiant.com/yopofrsqma.html> (Year: 2013).*

Screen captures from YouTube video clip entitled "Elitefts.com: Exercise Index—Wide Stance Power Squat," 9 pages, uploaded on Nov. 14, 2009 by user "Elitefts Archives," Retrieved from Internet: <https://www.youtube.com/watch?v=MfDYKyxT8Kg> (Year: 2009).*

* cited by examiner

POWER SQUAT EXERCISE MACHINE

CROSS-REFERENCE TO RELATED APPLICATIONS

This application claims priority from the US non-provisional patent application Ser. No. 62/410,202 filed Oct. 19, 2016 and the disclosure of which are incorporated herein by reference in their entirety.

FIELD OF THE INVENTION

The present invention relates in general to exercise machines and in particular to a power squat exercise machine.

BACKGROUND OF THE INVENTION

The squat is an exercise wherein the knees and hips are flexed and then extended. A person's body weight and any additional added resistance is lowered and then lifted back to a standing position whereby the legs and hips are fully extended. To complete this exercise, the bodyweight of the user and any additional resistance must be balanced directly over one's center of gravity and center of mass, for the most efficient use of force and in order to keep the balance. In this manner, the weight of the body and the resistance are moved downward and then upward against gravity to exercise the muscles of the legs and the torso. Additional weight may be attached to the exerciser if the user balances a bar on his/her shoulders, back, around the waist, or in the hands in order to increase the effort required to perform a squat and create a desired physical adaptation.

Typically, the free weight squat exercise is completed in a rack, whereby a loaded barbell is lifted out of the rack by the user and then supported by the user who holds the bar on their shoulders or upper back. The exercise is started with the user standing under a supported barbell and then engaging and supporting the bar by lifting it up and out of the rack bar holder by standing erect with the bar on their back and both feet flat on a floor with the feet spaced shoulder width apart. The user then bends the knees and hips to lower the bar. The torso must be leaned forward to some degree in order to maintain a balance of the resistance directly over the feet or the user's center of gravity. The angle of the back from vertical to a more forward angle tends to increase as the descent increases. This rotation about the hip joints will concentrate stress on the exerciser's lower back erector spinae muscle group, thereby increasing the tension on the muscles of the lower back. The lowering of the bar will require the tilting of the back and cause the knees to extend forwardly over the toes, thereby placing substantial shearing forces on the knee joint. Thus, great care must be taken to use a responsible amount of resistance, and to maintain correct postural form to avoid injuries when doing a squat exercise. In addition to the chance of injury, it is sometimes difficult to maintain balance over the feet when performing a squat exercise. This difficulty can become more dangerous as additional resistance is used and additional repetitions are performed and fatigue and exhaustion begin. It is desirable to have a stopper system of some kind when performing any type of free weight squat exercise, or power squat machine exercise.

The squat is an important exercise for weight lifters and body builders, but it is also practiced by many other athletes and gym members. A power squat machine is designed to provide a more controlled manner of practicing this exercise, whereby the movement pattern is dictated by the machine. The power squat is particularly effective in building up the hamstrings and the quadriceps muscles of the legs. It can also build up the back, the hip, and the lower leg muscles, and generally all of the muscles of the legs.

Squat exercises is commonly performed by balancing a weighted bar on the shoulders behind the neck, and squatting while supporting the weight. There are numerous issues with this practice. For instance, if the person has an injured hand, arm or shoulder, he/she may not be able to properly balance the weighted bar. Furthermore, if the person is new to the free weight squat exercise, he/she may not have sufficient strength or balance or coordination to effectively perform such a free weight squat.

While there are a number of different types of prior power squat exercise machines, there is still much room for functional improvements. Most such machines use lever designs to create great positive leverage for the user in comparison to a free weight squat. This leverage requires a great amount of resistance to challenge the user and create adequate stimulus for a new and desired physical adaptation. Therefore, one required improvement is to provide ability to add much greater resistance and different types of resistances on such machines.

This is achieved by designing and creating specific angles on the shoulder pads, large enough foot plate and a safe, practical stopper system. This design creates a more natural and safer movement pattern, which is far more natural and congruent with normal human biomechanical movements under a load. Furthermore, resistance band hooks can be added to the machine to allow for adding almost unlimited resistance to this exercise.

SUMMARY OF THE INVENTION

The present invention is a squat exercise machine for performing squat exercise in a safe and controlled manner. The apparatus allows the user to control the movement of the resistance by stopping it and disengaging it from being supported by the user's body, back to being supported by the metal frame of the machine. Therefore, if the user can no longer voluntarily support the resistance for any reason and it begins to move downward and collapsing the user, the resistance will safely and automatically be caught and stopped by the machine, thus preventing any possible injury to the user.

The machine provides a base frame, having a front side and a rear side, which is engaged with the floor. There is an extra wide and long slanted foot platform on which the user may adjust their stance to varying degrees: approximately 24 inches wide by 48 inches long (for width of feet) and with a rubber surface to provide maximal traction to keep the user's feet firmly in place. The resistance at one end of the machine, and the foot platform and shoulder pads where the user is situated at the other end of the machine, creates a lever and an axis. The axis and the distance of the user from the axis creates a fixed arcing pattern to which the user must adhere when moving the shoulder pads up and down in using this machine. This arcing pattern and the slanted foot platform emphasize the "hinge" of the hips backward to create and improve the form in the free weight squat. The lever aspect of this machine and the fixed arcing movement pattern to which the user is fixed creates a situation whereby the user does not require the coordinating, balancing, neutralizing and stabilizing muscular functions of a completely free weight squat.

The base frame includes horizontal and vertical support members, to provide stability to the machine. The frame includes a pivotally moveable member to which resistance plate holders, a back support, two pairs of shoulder pads and hand grips are attached. The moveable member moves pivotally along an axis of to the frame and is designed to permit the user to flex or bend his or her knees and hips in a squatting motion.

The squat exercise machine further includes dual stopper system. The main stopper is a strong metal adjustable stopper to provide controlled movement by the user. The main stopper system includes a foot plate perpendicular to the foot platform and a pivot arm to stop the movement of the moveable member. The stopper system is hinged and engaged to the base frame. This allows for a safe entry and exit from the squat exercise machine. The user can stop the machine by stepping on the foot plate of the stopper system with one foot during the squat exercise facing the resistance enabling the pivoting arm of the stopper system to engage with the bottom section of the moveable member to stop the machine. This stopping mechanism disengages automatically via gravity with the use of a counter weight. When the user begins the exercise by disengaging the resistance to his/her own bodily support, they lift up the resistance by pushing their shoulders into the shoulder pads.

The machine further provides a second stopper mechanism including a safety locking metal rod having a rigid pin. This safety stopper allows for the adjustable, restriction limitation of the range of the movement of the resistance via the range of the possible movement of the moveable member. It may also be used to limit range in the exercise for a specific training effect or due a user's injury. The dual stopper mechanism of the machine provides a safe entry and exit from the machine in squat exercise facing into or away from the resistance.

The moveable member provides a back pad and a pair of shoulder pads to enable the user to use the machine facing into or away from the resistance plates. Facing the resistance plates creates a greater emphasis on the posterior chain muscles of the hamstrings, glute, hip muscles and lower back. Facing away from the resistance and leaning on the back pad creates a greater emphasis on the anterior, quadriceps muscles of the legs and the hip flexor muscles.

This machine effectively allows a "shrug" exercise movement and various forms of calf or lower leg muscle exercises as well. The machine further provides a novel shoulder pad design to perform the power squat exercise when facing the resistance. The shoulder pads are angled at approximately 32 degrees from the frame holding the shoulder pads (which is at 0 degrees). This creates an optimally direct force vector into the apex of the shoulder pads when the user is most symmetrically positioned over the user's center of gravity and center of mass, at typically the most difficult part of the squat in practice and from a force and leverage standpoint. This is the point of the squat range where the most force is required and created to complete the exercise.

This point not at the top nor the bottom of the range, but rather at approximately the middle of the range where knee flexion is approximately 90 degrees. It is at this point in the range of the movement that the apex of the shoulder pads is perfectly symmetrical to the user's center of gravity and thus the force vector created by the user is most directly into the apex of the shoulder pads. This design creates the most comfortable and realistic application of the user's force relative to the most difficult part of the range. The approximately 32 degree angle design of the shoulder pads, in creating the most symmetrical and direct force vector into the center or apex of the pads during the most difficult point in the squat range also assists the user in keeping a healthy and extended lower back position. A zero degree shoulder pad angle, typical of common power squat machines will tend to push the shoulders and upper back of the users over, tending them forward and downward and will thus cause their lower back to round which will increase the likelihood of injury when using such a machine.

The back pad and shoulder pads are padded to enhance user comfort while exercising. This structure creates an apparatus enabling the user to perform a front squat type movement allowing the user's back to engage the back pad while the user's shoulders engage the shoulder pads to push the back and shoulder pads upwardly. The structure of the shoulder pads for use when facing the resistance allows the user to lower the resistance when engaging the shoulder pads and resistance by moving the hips backward and sitting back or hinging the hips to ensure a safer lower back posture and to accommodate a healthy extension of the lower back.

Two weight plate resistance holders, one on each side of the machine are attached to the moveable member to receive the weight plates as resistance when the machine is being used.

Two weight plate storage holders per side of the machine are engaged to the frame of the machine at the rear side of the machine to receive the weight plates for storage when they are not in use as actual resistance on the machine.

A pair of two sided hand grips are provided on the sides of shoulder pads on the moveable member to provide a safe grip for the user while using the machine in both facing and facing away from the resistance.

The power squat machine is further equipped with band hooks to allow the use of resistance bands for exponential resistance. Bands also allow for 3 types of resistance: Static weight, exponential band resistance, and the combination of both.

To use the machine the user can either stand on the foot platform facing away from the resistance, in front of the machine and bend his/her knees lean his or her back against to the back pad and drive his/her shoulders into the shoulder pads. Alternatively, the user may stand on the foot platform facing the resistance and the back pad leaning the shoulders into the shoulder pads and grabbing the hand grips. The user performs a squat exercise by initially pressing against the shoulder pads upwardly with their shoulders. This causes the disengagement of the stopper system from the frame of the machine and onto the support of the user's body. The stopper mechanism enables the user to continue the exercise until it is finished, whereby they may use one foot to press down on the foot plate of the stopper to allow the disengagement of the support of the resistance from the user, back to being supported by the machine. Alternatively, if the user is unable to push the weight upward volitionally or if they are not able to create enough force to overcome the resistance, resulting in the shoulder pads and resistance crushing down on the opponent, then they may simply yield and allow the resistance to rest safely on the secondary stopper, responsibly set to a level just below the particular working range of the squat movement the user is performing.

The stopper may also be used to limit range in the exercise for a specific training effect or due a user's injury or for creating strength or a desired training effect within a specific range of the power squat movement. The stopper allows the user to safely "overload" the machine and the squatting exercise pattern it creates with a supra-maximal amount of resistance relative to a free weight squat. This taxes the nervous system, muscles, bones, connective tissue and neuro-muscular system in general such that the user may safely use this machine in this way to overcome a free weight squat resistance amount that they were previously unable to lift when attempting a free weight squat.

The stopper allows the user to safely end the exercise by simply lowering the weight onto it instead of using the alternative foot plate to disengage the resistance. Using the foot plate involves moving the feet closer together, standing on one foot, and pressing against the foot plate with the other foot to disengage the resistance, all while still holding and supporting the resistance. After heavy exercise, and in a likely state of muscular fatigue or exhaustion, this movement and balancing onto one foot can create a greater chance of injury to the user. This can be dangerous as the person must move their feet, support the entire resistance weight with one foot instead of two feet, balance the entire resistance load on a single foot/leg, and successfully push the foot plate with the other foot that will then allow the frame to support the resistance, such that the user can step out of the machine.

The user will then be disengaged from supporting the resistance as the stopper mechanism will provide full and complete support for the resistance and the user may exit the machine.

It is an object of the present invention to allow for the full body compound free weight movement and exercise to be completed in a controlled, safe situation and pattern.

It is another object of the present invention to be used as a learning tool, or an exercise that will assist when one is injured and may not be able to balance a bar on their back in a free weight squat.

It is another object of the present invention to provide an improved power squat exercise machine that minimizes negative and optimizes positive and more natural stress upon joints associated with the muscle group that performs the squat movement.

It is another object of the present invention to provide more natural human movement pattern of the squat exercises.

It is another object of the present invention to provide an extra-large foot platform to allow for maximal variation of foot stance, more optimal involvement of the hip muscles and for different desired training adaptations and users of different heights sizes, leg and torso lengths.

It is another object of the present invention to provide a secure and safe entry and exit of the machine by providing a main stopper system that enables the user to safely step on the main stopper system during the exercise to stop the machine.

It is another object of the present invention to provide a secure and safe entry and exit of the machine and to prevent possible injury by providing a secondary adjustable stopper mechanism that enables the user to automatically avoid injury by having the resistance fixed such that it cannot lower beyond a desired, safe range that is pre-set by the user.

It is another object of the present invention to effectively allow the user to perform a "shrug" exercise movement and various forms of calf or lower leg muscle exercises.

It is another object of the present invention to provide two pairs of shoulder pads to enable the user to use the machine facing into or away from the resistance safely by providing dual stopper mechanism.

Another object of the present invention is to provide angled shoulder pads which allow the effective use of the squat machine, given the force vectors that occur with the more open angles of this machine which replicate the actual free weight movements of various forms of the squat exercises at the approximate point in the squat exercise where typically the most force is required and created by the user to move the resistance upward and effectively complete the exercise movement.

Another object of the present invention is to provide a squat exercise machine with an adjustable locking stopper mechanism for a safe and secure exercise and to enable specific training by adjusting the range of the movement to various ranges.

It is another object of the present invention for the user to use the secondary stopper to rest the resistance upon during the power squat exercise, before pressing the resistance off of the stopper. This allows for a specific training effect in which the eccentric or lowering of the resistance and the concentric or raising the resistance are broken up when the user rests the resistance briefly on the stopper. This creates a specific training effect whereby all of the muscles involved in the power squat movement are more emphasized and must be more intensely contracted.

It is another object of the present invention to provide a squat exercise machine that can be used with 3 forms of resistance: Static weight, exponential band resistance, and the combination of both static weight and band resistance.

Other objects, features, and advantages of the present invention will be readily appreciated from the following description. The description makes reference to the accompanying drawings, which are provided for illustration of the preferred embodiment. However, such embodiments do not represent the full scope of the invention.

BRIEF DESCRIPTION OF THE DRAWINGS

Embodiments hereinafter will be described in conjunction with the appended drawings provided to illustrate and not to limit the scope of the claims, wherein like designations denote like elements, and in which:

DETAILED DESCRIPTION OF PREFERRED EMBODIMENTS

Figure 1:
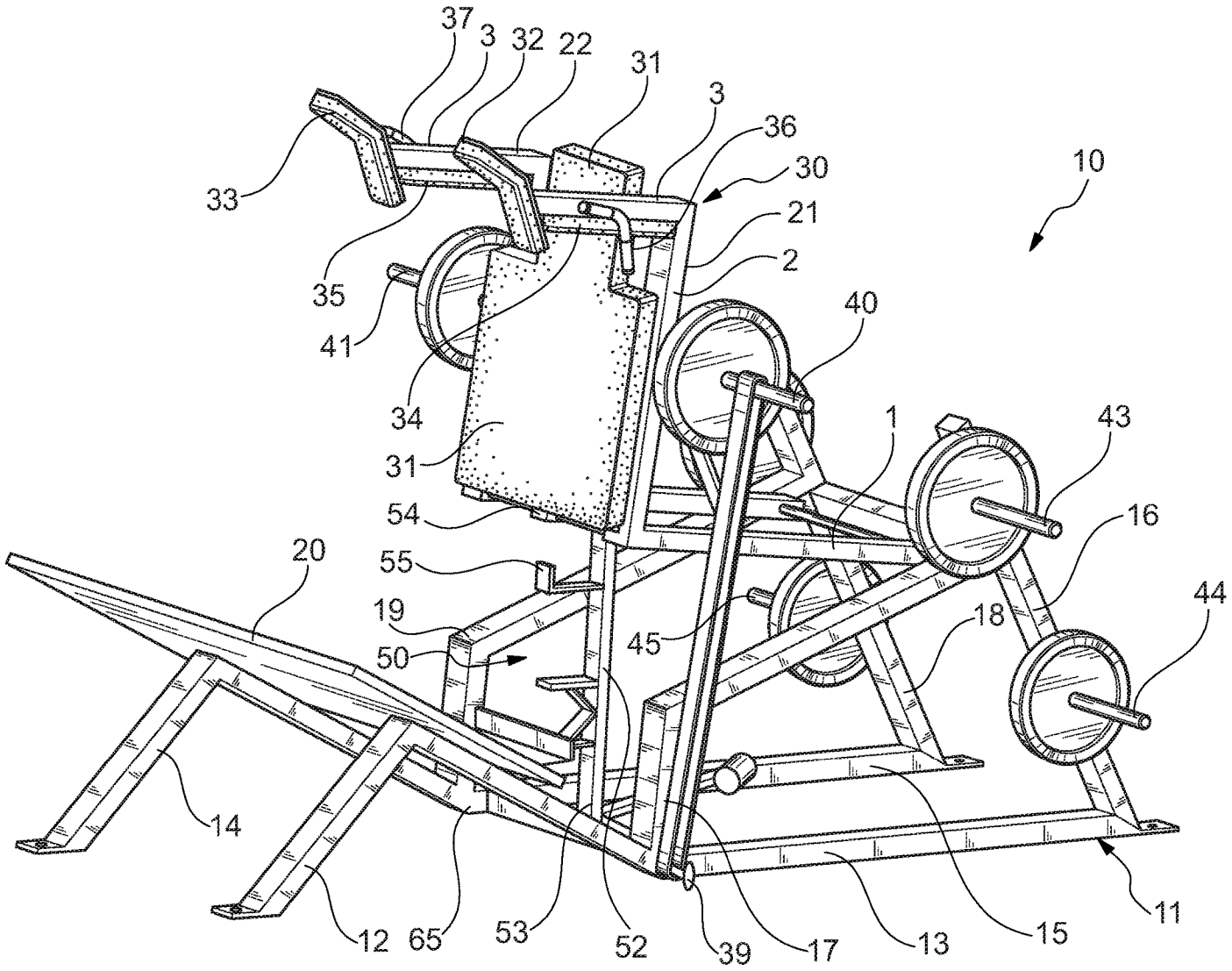
FIG. 1 is a perspective view of the power squat exercise machine according to the present invention.
Figure 2:
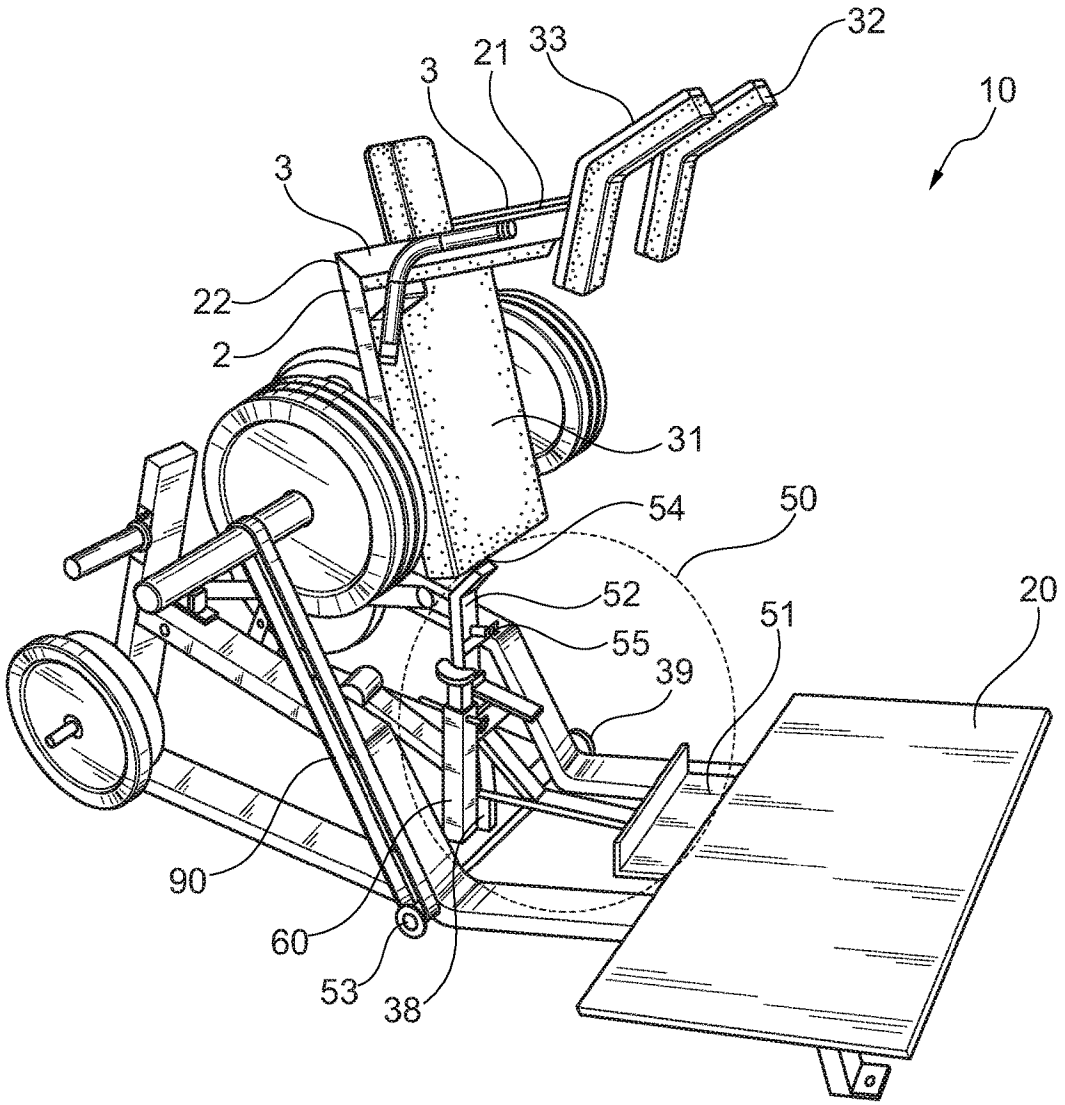
FIG. 2 is a perspective view of the power squat exercise machine according to the present invention.
Figure 3:
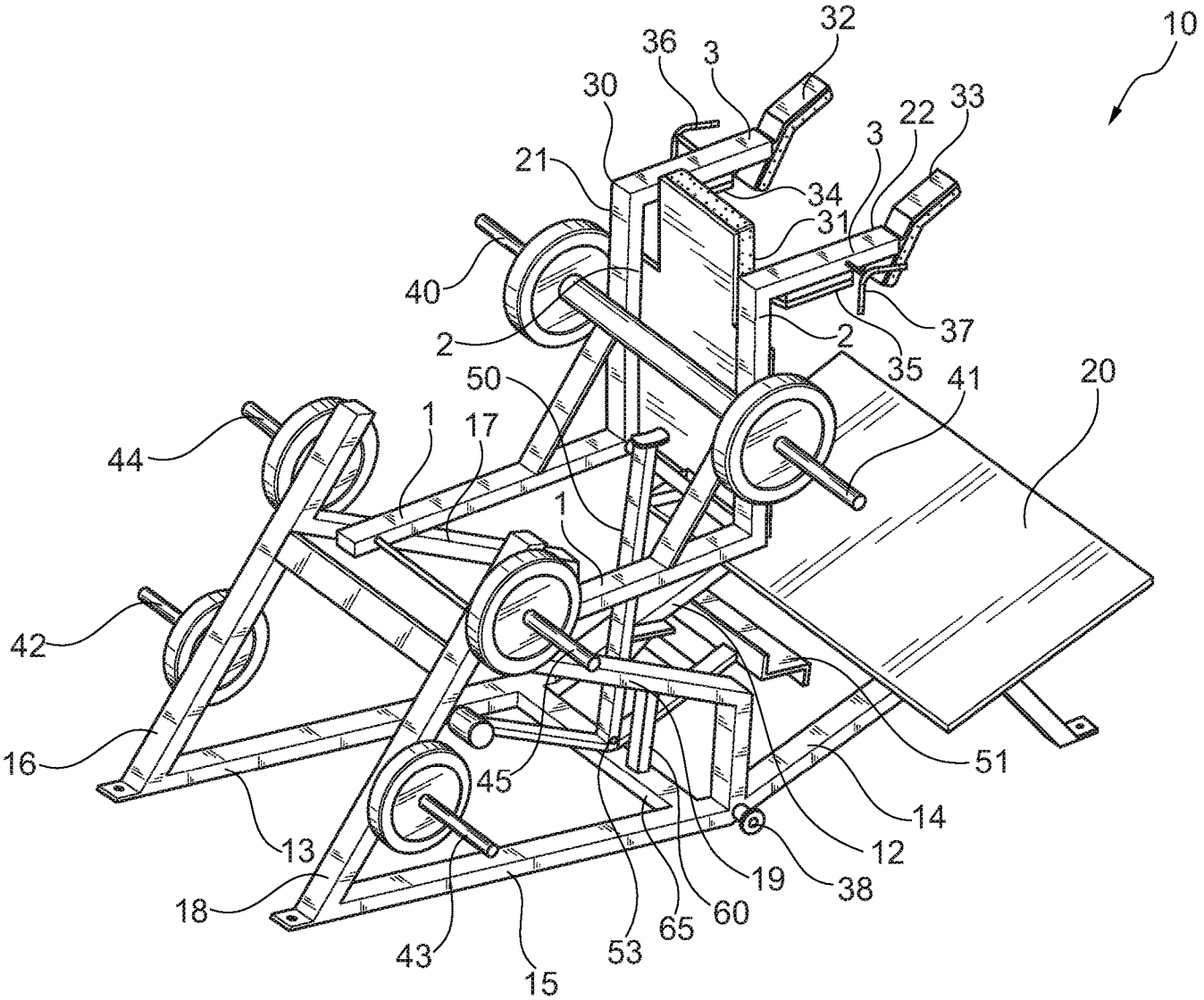
FIG. 3 is a perspective rear view of the power squat exercise machine according to the present invention.
Figure 4:
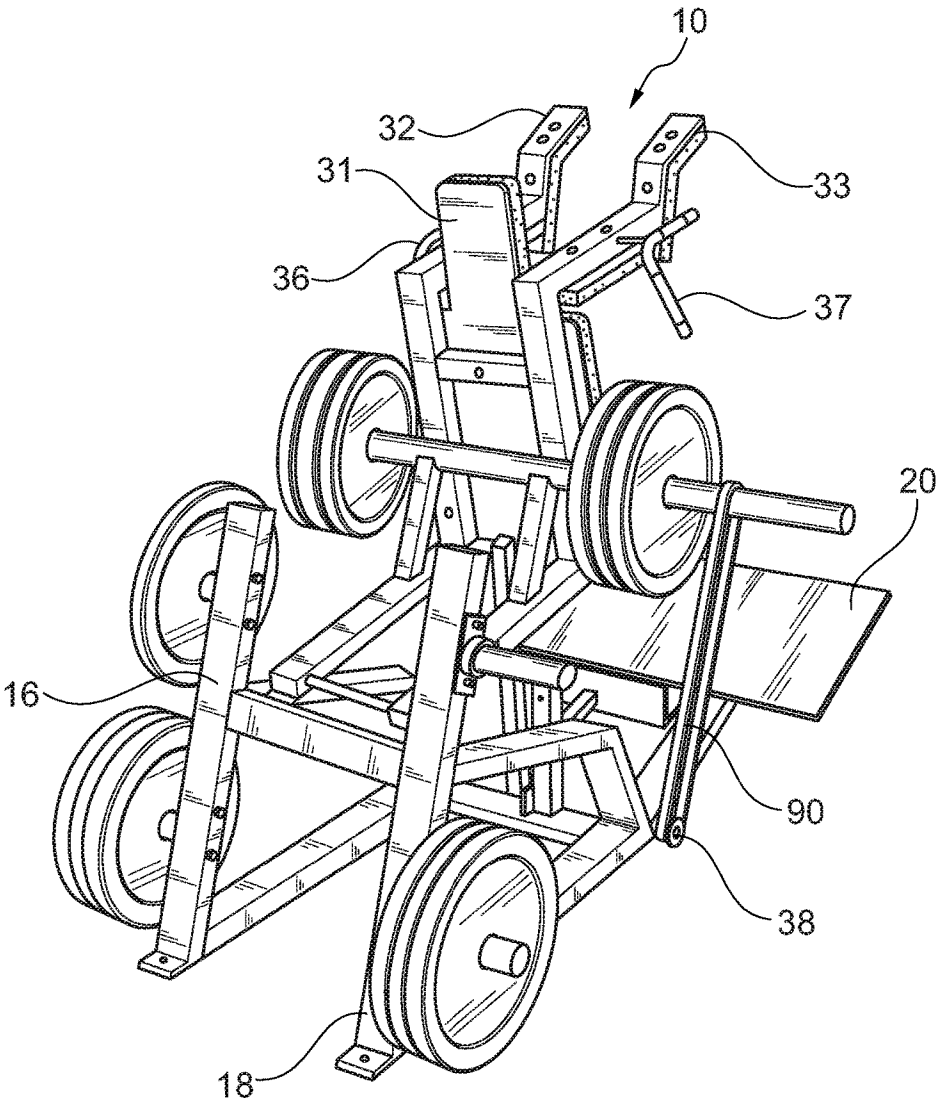
FIG. 4 is a perspective rear view of the power squat exercise machine according to the present invention.

According to FIGS. 1, 2, 3, 4 and 5 a power squat exercise machine 10 is disclosed. The machine 10 includes a base frame 11 which is large enough to provide stability to the machine. The base frame 11 includes side supports in the front side 12, 14 and side supports in the rear side 13, 15 of the base frame. The front side supports 12, 14 are V-shaped supports installed parallel to each other and angled with the floor. The rear side supports 13, 15 are parallel to each other and engaged with the floor and have elongated vertical support beams 16, 18 and 17, 19 to install and support the base parts of the squat machine.

A large foot platform 20 on which the user stands for performing the power squat exercise is engaged to the front side supports 12 and 14 of the frame so that the foot plate makes an angle with the floor. The size of the foot platform 20 is approximately 24 inches wide by 48 inches long (for width of feet) and with a rubber surface. The foot platform 20 and the arcing pattern inherent in this machine due to the axis and lever nature of the machine emphasizes the "hinge" of the hips backward to create and improve form in the free weight squat.

The frame includes a pivotally moveable member 30 to which resistance plate holders 40, 41 and user support members are attached. The moveable member 30 comprises of two parallel Z-shaped arms 21, 22 pivotally attached to the vertical legs 16, 18 of the frame 11 from their distal end and move pivotally along an axis of the frame 11. Each Z-shaped arm 21, 22 comprises a set of lower arms 1, a set of upper arms 2 and a set of vertical arms 3. The moveable member 30 is designed to engage with the back and shoulders of the user to permit the user to bend his or her knees in a squatting motion. The moveable member includes a back pad 31 attached to the second legs 2 of each Z-shaped arm 21 and 22, shoulder pads 32, 33 are attached to the end of the third leg 3 of each Z-shaped arm 21, 22 and shoulder pads 34, 35 are attached to the bottom side of the third legs 3. The moveable member further includes hand grips 36 and 37 attached to the sides of the third legs 3 of the z-shaped arms 21 and 22.

Figure 5:
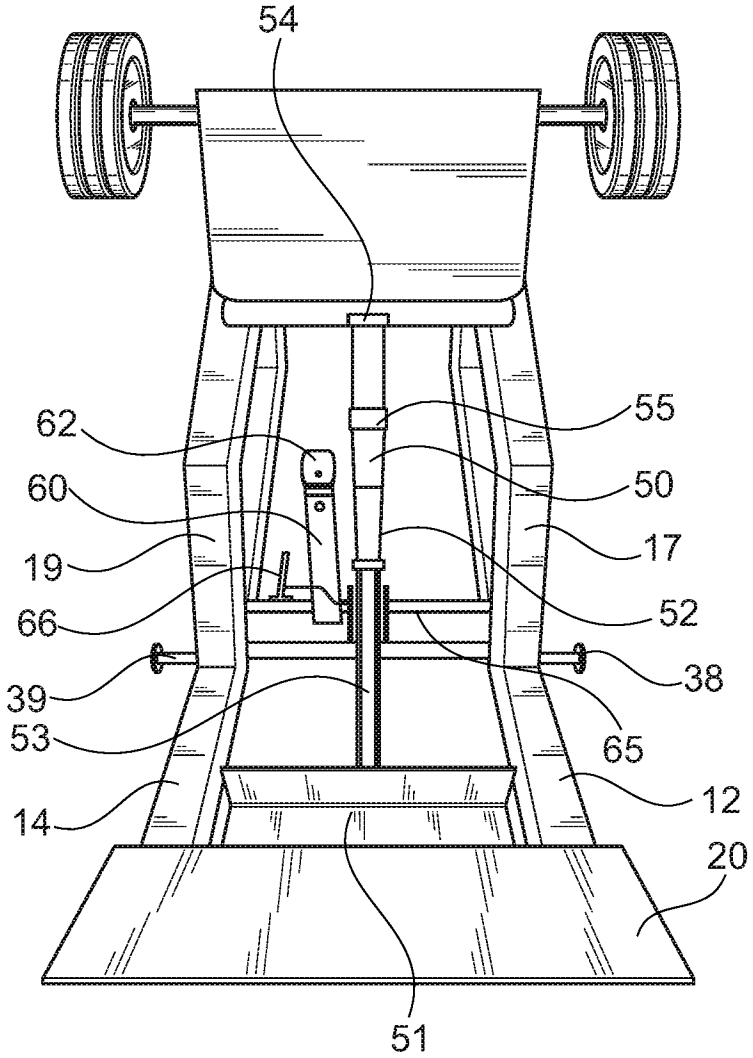
FIG. 5 is a perspective view of the present invention showing the dual stopper system.
Figure 6A:
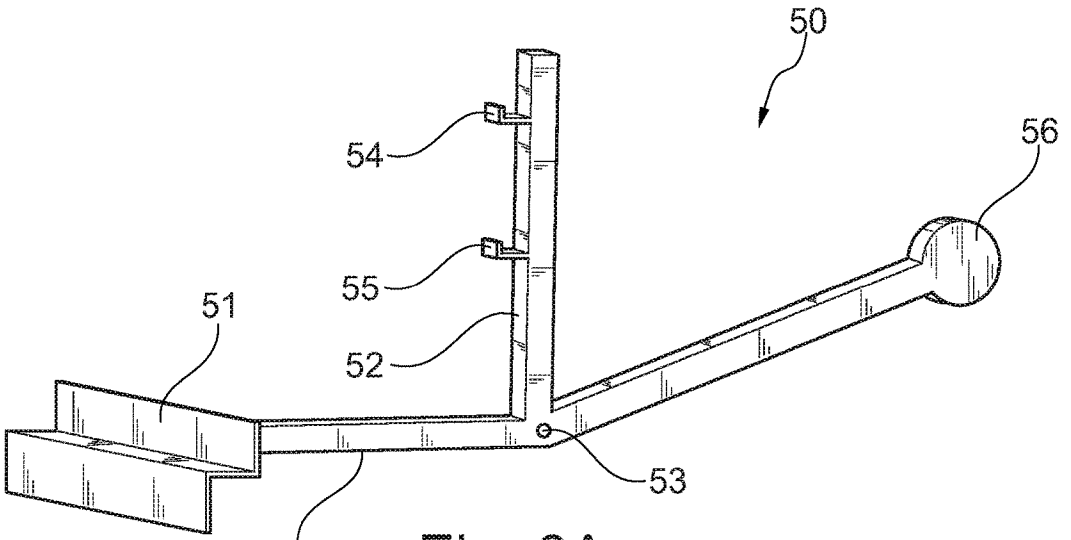
FIG. 6A is a schematic view of the main stopper of the present invention.
Figure 6B:
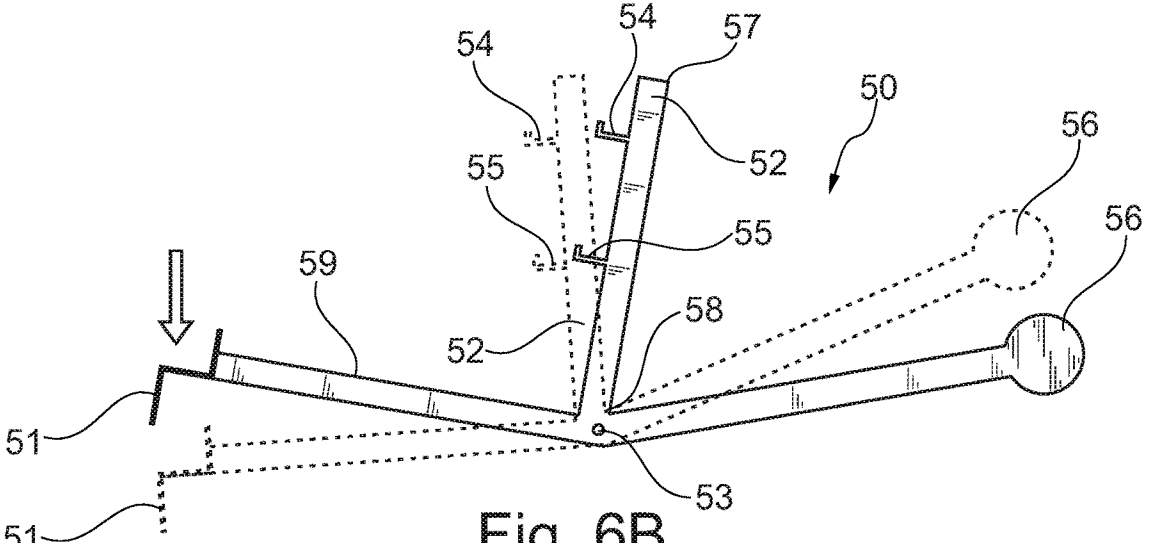
FIG. 6B is a schematic view of the main stopper of the present invention.

According to FIG. 5, FIG. 6A and FIG. 6B the squat exercise machine further includes a main stopper 50 to provide controlled movement by the user. The main stopper system 50 is a strong metal stopper pivotally secured to a horizontal leg of the base frame 65. The main stopper comprises an upwardly extending pivot arm 52 attached to a foot plate 51 by a foot beam 59 perpendicularly adjacent to the foot platform 20 of the frame. The pivot arm 52 of the main stopper 50 has an arm-distal end 57 and an arm-proximal end 58 and is hinged and engaged to the base frame 11 from its proximal end 58 and pivots on the pivot point 53. One or more catches 54 and 55 are provided on the body arm-distal end 57 of the pivot arm 52 of the main stopper 50 to stop the movement of the moveable member 30. The counterweight 56 forces the stopping mechanism to lean backward via gravity. This enables the user to continue the exercise until it is finished. The user disengage his/her bodily support of the resistance while standing in an upright position with knees and hips fully extended and squatting the resistance up successfully, by pressing one foot onto the stopper systems foot plate 51 and thereby disengaging the resistance and transferring the support of the resistance back to the machine. Volitionally, the user can stop the machine 10 by stepping on the foot plate 51 of the main stopper system 50 during the exercise enabling the stopper system to engage with the bottom section of the pivotally moveable member 30 to stop the machine.

In this way the user may then freely step out from under the shoulder pads and exit the machine. Alternatively, the machine includes a second stopper 60 which is an adjustable safety stopper and if the user fails to lift the resistance weight and is involuntarily yielding the resistance, they may simply yield and allow the resistance to rest safely on the second stopper 60.

The second stopper 60 may also be used to limit range in the exercise for a specific training effect such as improving strength in one part of the range of the squat, removing the myotatic stretch reflex to emphasize muscular strength improvement over connective tissue strength improvement, or due a user's injury. The second stopper 60 allows the user to safely "overload" this machine and the squatting exercise pattern it creates with a supra-maximal amount of resistance relative to a free weight squat. This taxes the nervous system, muscles, bones, connective tissue and neuro-muscular system, in general such that the user may safely use this machine in this way to overcome a free weight squat resistance amount that they were previously unable to lift.

According to FIG.5 again the second stopper 60 comprises a telescopic leg mounted on the horizontal leg of the base frame 65 close to the main stopper 50. The second stopper 60 is adjustable by a steel pin 66 in communication with a set of apertures 68 and includes a holder 62 on its distal end. Adjustable safety stopper 60 allows for the user to safely end the set of exercise by simply lowering the weight onto the second stopper 60 instead of using the alternative foot plate 51 of the first stopper 50 to disengage the resistance. The second stopper 60 further allows the user to adjust the height of the stopper 60 to the users comfort height.

The main stopper 50 involves moving the feet closer together, standing on one foot, and pressing against the foot plate 51 with the other foot to disengage the resistance, all while still holding and supporting the resistance, after exercise that can be exhausting. This can be dangerous as the person must move their feet, and support the entire resistance weight with one foot instead of two feet, balance the entire resistance load on a single foot/leg, and successfully push the foot plate 51 with the other foot that will then allow the frame 11 to support the resistance, such that the user can step out of the machine 10. With typical, similar machines if anything goes wrong during this process, the user can get crushed under the resistance weight which they are still supporting with no way for it to be stopped.

Figure 12:
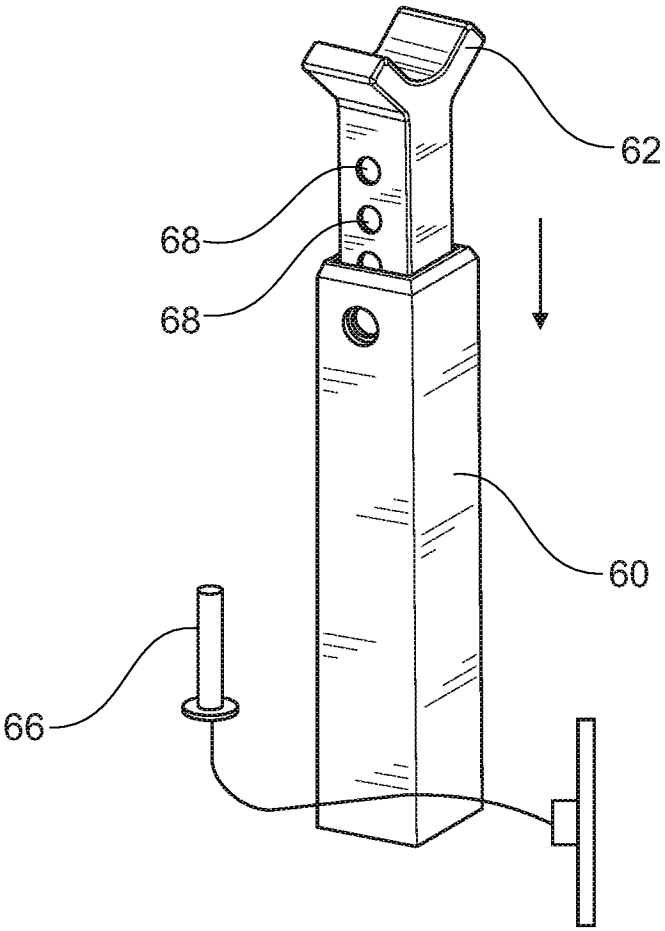
FIG. 12 is a perspective view of the second stopper of the present invention.

As shown in FIG. 12 clearly the second stopper 60 is a telescopic leg comprising a plurality of apertures 68 to adjust the height of the second stopper 60 by using a pin 66. The second stopper 60 further adjust the movement range of the machine according to the user's safe squatting range, comfort, or desired training effect. The second stopper 60 allows for the adjustable, restricted and limited range of the resistance and the range of the movement of the moveable member 30. This allows for a safe entry and exit from the squat exercise machine.

The frame includes plate holders 40, 41 which are engaged to the moveable member to receive the weight plates as resistance to provide the desired weight resistance during the exercise. Two weight plate storage holders per side of the machine 42, 43, 44 and 45 for a total of four are engaged to frame at the rear side of the machine to receive the weight plates for storage when they are not in use as actual resistance on the machine.

The moveable member 30 has a back pad 31 and two pairs of shoulder pads 32, 33 and 34, 35. The back pad 31 is attached to the second legs 2 of each Z-shaped arm 21 and 22 to the moveable member 30. The shoulder pads 32, 33 and 34, 35 enable the user to use the machine facing into or away from the resistance plates. The moveable member 30 is designed to engage with the back and shoulders of the user to permit the user to bend his or her knees in a squatting motion. The shoulder pads 32, 33 are attached to the end of the third leg 3 of each Z-shaped arm 21, 22 and shoulder pads 34, 35 are attached to the bottom side of the third legs 3. The moveable member 30 further includes hand grips 36 and 37 attached to the sides of the third legs 3 of the z-shaped arms 21 and 22.

Facing the resistance plates creates a greater emphasis on the posterior chain muscles of the back of the legs, the lower back muscles, and the hip muscles. Facing away from the resistance and leaning on the back pad creates a greater emphasis on the anterior, quadriceps muscles of the legs and the hip flexor muscles as well as muscles of the torso. This machine effectively allows a "shrug" exercise movement which emphasizes the upper trapezius muscles and various forms of calf or lower leg muscle exercises as well.

The first shoulder pads 32, 33 attached to the ends of the Z-shaped arms create a 32 degree angle from the frame holding the shoulder pads (which is at 0 degrees). This creates a direct force vector optimally into the apex of the shoulder pads which is perfectly symmetrical over the user's center of gravity and center of mass, at typically the most difficult part of the squat in practice and from a force and leverage standpoint.

The second shoulder pads 34, 35 are attached beneath the third leg 3 of the Z-shaped leg 21 and 22 of the moveable member 30 perpendicular to the back pad 31 to allow for a Hack squat or what is similar to a front squat movement. This structure creates an apparatus enabling the user to perform a Hack squat or front squat type of squatting movement allowing user's back to engage the back pad 31 while the user's shoulders engage the shoulder pads 32, 33 to push the back and shoulder pads upwardly.

The structure of the second shoulder pads 34, 35 allows the user to yield the resistance downwardly on the machine, driving the hips back, while sitting back in the squat to accommodate a healthy extension of the lower back and more optimal emphasis on the posterior chain muscles. This "hinging" of the hips and healthy posture of the lower back is vital for squatting correctly with a free weight. The back pad 31 and shoulder pads 32, 33 and 34, 35 are padded to enhance user comfort while exercising.

A pair of two-sided hand grips 36, 37 are attached to the sides of the upper arms 3 of the z-shaped arms 21 and 22 of the machine. The grips 36, 37 provide a safe grip for the user while using the machine in both facing into and facing away from the resistance plate holder.

The power squat machine is further equipped with band hooks 38, 39 to allow the use of resistance bands 90 for exponential resistance. Bands also allow for 3 types of resistance: Static weight, exponential band resistance, the combination of both.

Figure 7:
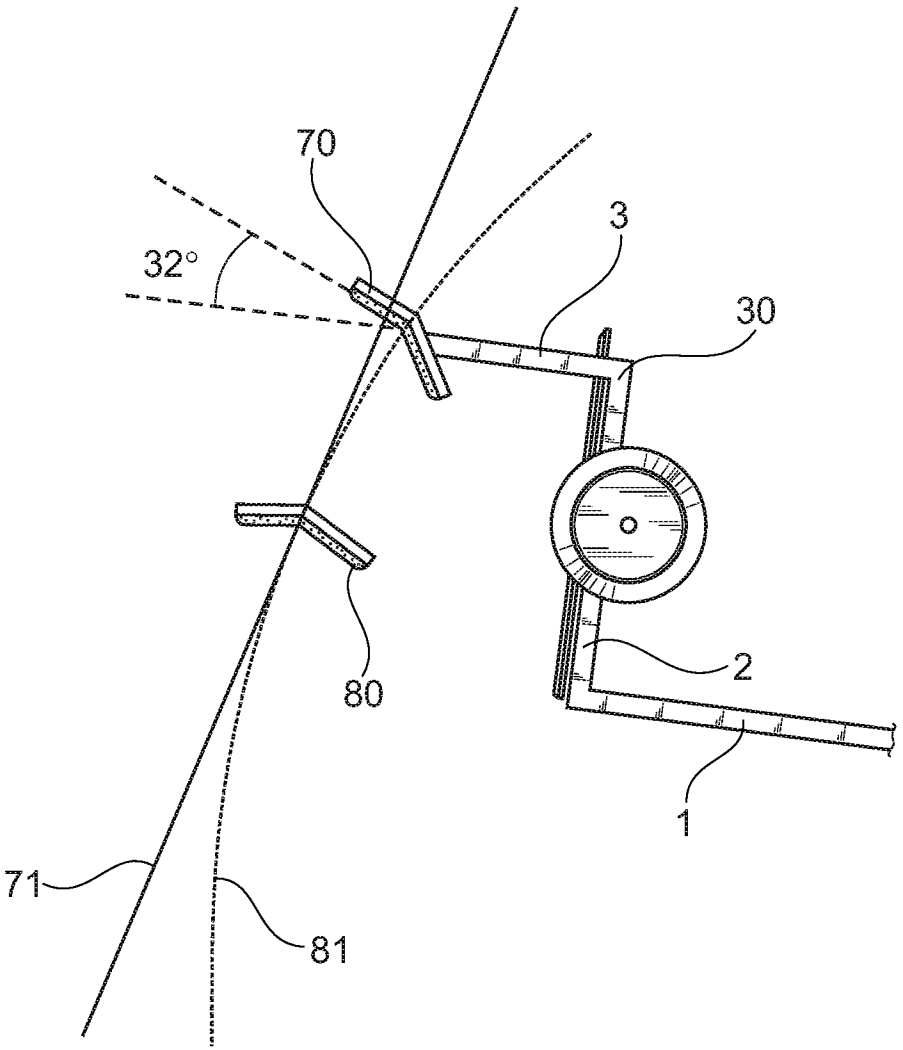
FIG. 7 is a schematic view of the angles of the shoulder pads according to the present invention.
Figure 8:
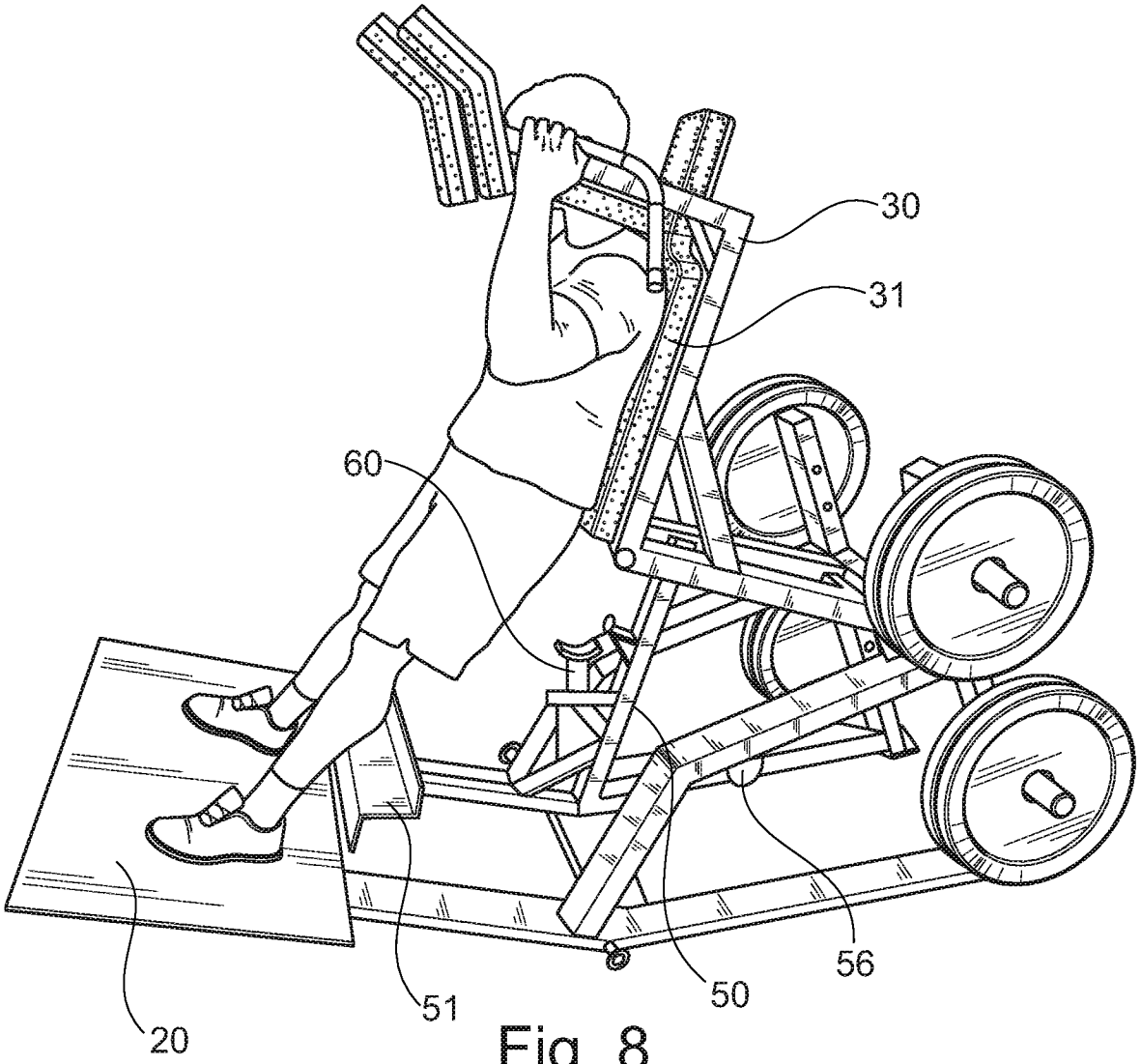
FIG. 8 illustrates a user performing squat exercise while using the present invention.
Figure 9:
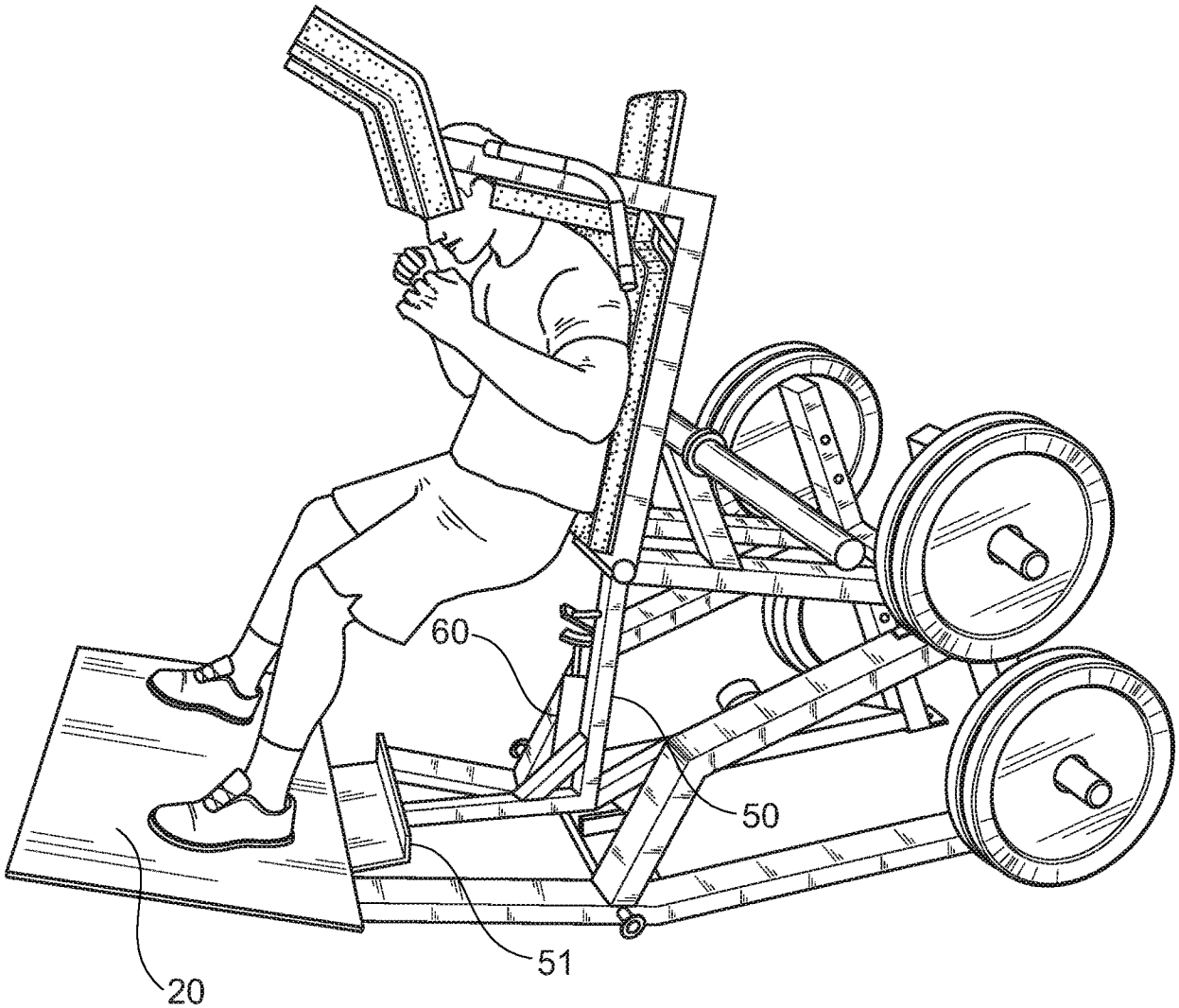
FIG. 9 illustrates a user performing squat exercise while using the present invention.
Figure 10:
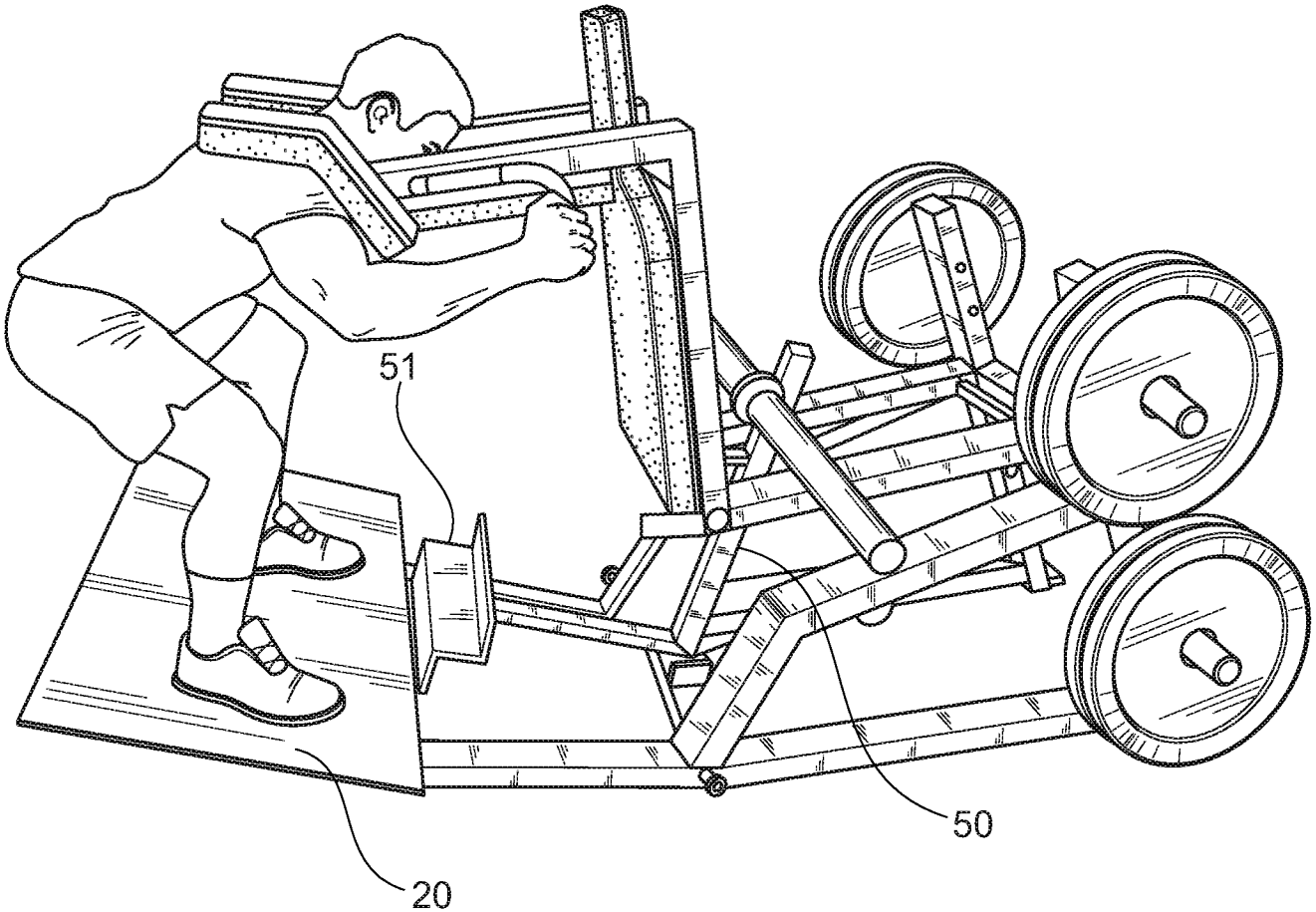
FIG. 10 illustrates a user performing squat exercise while using the present invention.
Figure 11:
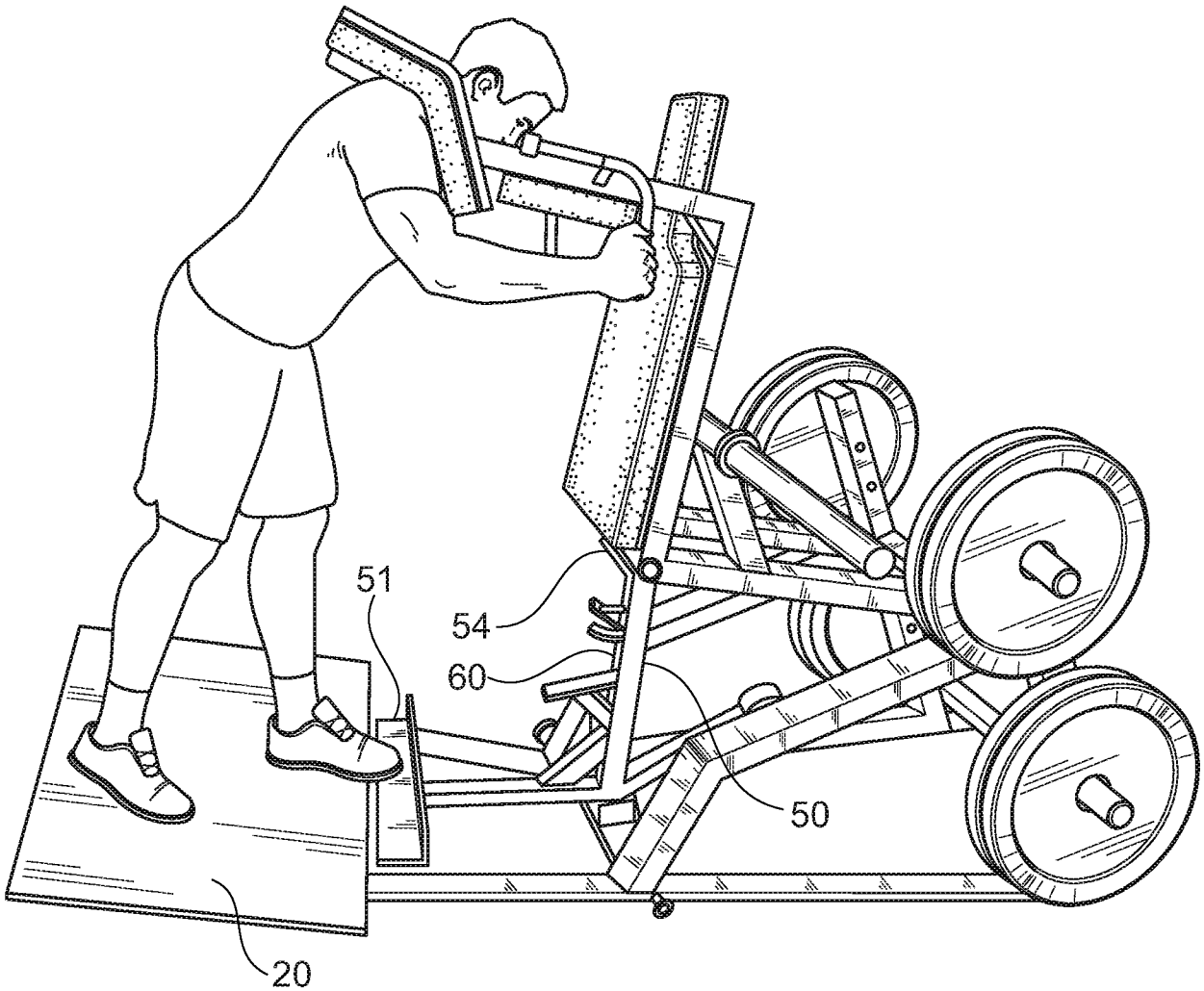
FIG.11 illustrates a user performing squat exercise while using the present invention.

According to FIG. 7, the angled shoulder pad illustrated in this machine is shown by numeral 70. The 32° best accommodates the particular point in the movement arc, where force created and required is greatest by the user. Force vector 71, the straight line of force, where the apex of the shoulder pads that connect the resistance to the user is perfectly symmetrical to user's center of gravity, directly perpendicular to the force vector/ line of force. This point in the squat range is approximately half way up the arcing movement pattern range. It is typically where the average user will be at an approximately 90 degree knee flexion or bend, just above the point where the femur bone of the upper leg is approximately parallel to the foot plate (or floor) surface. Again, this is typically the most difficult part of the squat and where the most force is required to move the resistance upward. Therefore, it is the most reasonable and rational point in the squat range to create a perfectly symmetrical apex of the shoulder pad and where that apex is completely and evenly in line with the force vector of the arcing pattern, at that particular point in the range where moving the resistance is the most difficult.

Typically, on similar squat machines, the shoulder pads are fixed at 0 degrees in relation to the frame. This angle provides a more comfortable and symmetrical apex of the shoulder pads in relation to the user, in line with the force vector created at the point when the user is standing in the machine. Contrarily, it does not provide that optimal angle for the apex of the shoulder pads when the user requires the most inline force vector in relation to his/her position where the most force is required. Further, this angle of the shoulder is less optimal in the lowest part of the movement where it will act to bend the user over and out of a safe back position.

FIGS. 8, 9, 10 and 11 illustrate a user performing a safe Hack squat or front squat type of exercise using the present power squat exercise machine. The user performs a squat exercise by initially pressing against the shoulder pads 32, 33 upwardly with their shoulders. This causes the pivot arm of the main stopper 50 to automatically disengage via the counterweight attached to the stopper system arm. It also allows the user to volitionally to end the exercise by stepping on the stopper system foot plate 51 to disengage the support of the resistance from the user back to the frame of the machine. Further, it enables the user, if they are unable to continue the exercise until it is finished, to simply yield and allow the resistance to rest safely on the second stopper 60. As such, the second stopper 60 allows the user to safely end the set of exercise by simply lowering the weight onto the safety stopper 60 instead of using the alternative foot plate 51 of the main stopper 50 to disengage the resistance.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Including but not limited to creating an angle of the sliding resistance that is less than or greater than 20 degrees and back pad that will lower to less than 15 degrees both in relation to the horizontal floor.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A power squat exercise machine comprising:

a) a base frame having a front side and a rear side;

b) a foot platform attached to the front side of said base frame and having a predefined foot-platform angle with respect to a floor;

c) a pivotally moveable member having a set of lower arms that are pivotally engaged with said base frame, a set of upper arms, and a set of vertical arms, wherein each of the set of vertical arms connects each of the set of upper arms to each of the set of the lower arms;

d) a set of resistance plate holders securely attached to said pivotally moveable member to receive a set of weight plates;

e) a main stopper comprising:

i) an upwardly extending pivot-arm, an arm-distal-end and an arm-proximal-end that is hingedly engaged to said base frame, and a set of catch hooks on the upwardly extending pivot-arm to hold the pivotally moveable member, ii) a counterweight beam attached to said arm-proximal-end and extending towards the rear side of the base frame, wherein the counterweight beam is designed to force the upwardly extending pivot-arm to lean backwards towards the rear side of the base frame, and iii) a foot-beam attached to said arm-proximal end and extending towards the front side of the base frame, said foot-beam having a foot-plate, f) a second stopper mounted on said base frame close to said main stopper, wherein said second stopper has an adjustable height to limit the range of movement of said pivotally moveable member, whereby a user can lower the pivotally moveable member onto said second stopper to disengage said set of resistance plate holders.

2. The power squat exercise machine of claim 1, further having a first pair of curved shoulder pads each of said first pair of curved shoulder pads attached to a corresponding end of each of said set of upper arms and having a predefined shoulder-pad-angle with respect to said set of upper arms, whereby said first pair of curved shoulder pads are configured to allow a user to use said power squat exercise machine facing into said set of resistance plate holders and said predefined shoulder-pad-angle maintains a safe back posture when using the power squat exercise machine.

3. The power squat exercise machine of claim 2, wherein said predefined shoulder-pad-angle is approximately 32 degrees.

4. The power squat exercise machine of claim 1, further having a back pad rigidly mounted on said set of vertical arms of said pivotally moveable member.

5. The power squat exercise machine of claim 1, wherein said foot platform is approximately 24 inches wide by 48 inches long, to allow for maximal variation of foot stance, optimal involvement of hip muscles, and for different desired training adaptations for users of different heights, sizes, and leg and torso lengths.

6. The power squat exercise machine of claim 1, wherein said second stopper is a telescopic beam with a set of apertures and a pin to allow the user to adjust the height of the second stopper to a comfortable height for the user.

7. The power squat exercise machine of claim 1, further having a pair of straight shoulder pads, each of said pair of straight shoulder pads attached to a corresponding lower side of each of said set of upper arms, wherein said pair of straight shoulder pads are configured to allow the user to use said power squat exercise machine facing away from said set of resistance plate holders and to perform a safe Hack squat or front squat type of exercise.

8. The power squat exercise machine of claim 1, further having band hooks attached to sides of said base frame to allow for the use of resistance bands, thereby allowing for exponential resistance to be added to the power squat exercise machine, thereby allowing for three types of resistance, including static weight, exponential band resistance and a combination of both static weight and exponential band resistance.

9. The power squat exercise machine of claim 1, further having four weight plate storage holders to receive said set of weight plates for storage.

10. The power squat exercise machine of claim 1, further having a pair of two-sided handgrips, each of said pair of two-sided handgrips attached to a corresponding one of said set of upper arms to provide a safe grip for the user while using said power squat exercise machine when facing into or facing away from said set of resistance plate holders.

* * * * *